US006733244B1

(12) United States Patent
Fritsch et al.

(10) Patent No.: US 6,733,244 B1
(45) Date of Patent: May 11, 2004

(54) MICROFLUIDICS AND SMALL VOLUME MIXING BASED ON REDOX MAGNETOHYDRODYNAMICS METHODS

(75) Inventors: Ingrid Fritsch, Fayetteville, AR (US); Christopher S. Carter, Fort Smith, AR (US); Zoraida Aguilar, Fayetteville, AR (US)

(73) Assignee: University of Arkansas, N.A., Little Rock, AR (US)

( * ) Notice: Subject to any disclaimer, the term of this patent is extended or adjusted under 35 U.S.C. 154(b) by 0 days.

(21) Appl. No.: 10/026,748

(22) Filed: Dec. 19, 2001

Related U.S. Application Data

(60) Provisional application No. 60/278,278, filed on Mar. 22, 2001, and provisional application No. 60/257,331, filed on Dec. 20, 2000.

(51) Int. Cl.[7] ..... F04B 37/02
(52) U.S. Cl. ..... 417/48; 417/50
(58) Field of Search ..... 417/48, 50

(56) References Cited

U.S. PATENT DOCUMENTS

| | | | | |
|---|---|---|---|---|
| 4,921,661 A | * | 5/1990 | Leuer | 376/136 |
| 5,480,614 A | * | 1/1996 | Kamahori | 422/70 |
| 6,012,902 A | | 1/2000 | Parce | |
| 6,130,098 A | | 10/2000 | Handique et al. | |
| 6,146,103 A | * | 11/2000 | Lee et al. | 417/50 |
| 6,241,480 B1 | * | 6/2001 | Chu et al. | 417/99 |

* cited by examiner

*Primary Examiner*—Cheryl J. Tyler
(74) *Attorney, Agent, or Firm*—Head, Johnson and Kachigian

(57) ABSTRACT

Microfluidic channels utilizing magnetohydrodynamics are used to pump very small volumes of solution. The channels have electrodes along the walls of the channel and a current carrying species within the solution carries the current through the solution. The electric field generated by the use of the current carrying species is perpendicular to a magnetic field applied to the channel. The combination of the electric and magnetic fields causes the solution to flow through the channel.

13 Claims, 9 Drawing Sheets

MICROFLUIDICS AND SMALL VOLUME MIXING BASED ON REDOX MAGNETOHYDRODYNAMICS METHODS

This application is a continuation-in-part of U.S. provisional applications, Serial No. 60/257,331, filed Dec. 20, 2000, and Serial No. 60/278,275, filed Mar. 22, 2001.

BACKGROUND OF THE INVENTION

1. Field of the Invention

The present invention relates to microfluidic devices. In particular, the present invention relates to the use of magnetohydrodynamics to propel or mix fluids within microfluidic structures.

2. Prior Art

The field of microfluidics is growing rapidly. There is a strong desire to miniaturize chemical assays. A number of various technologies are currently being developed in an effort to develop what has become known as lab-on-a-chip (LOC) technology. It is believed that these technologies will lead to mobile, small scale chemical testing devices. Such devices would have a variety of applications. Emergency Medical Technicians and military medics could use such devices to rapidly analyze a person's blood chemistry. Forensic scientists could perform DNA analysis at a crime scene, instead of waiting hours or days for results from a laboratory. Realizing the great potential of such devices, there have been many attempt to find a low power method of accurately propelling extremely small liquid samples through microfluidic structures. The desired width of these channels is less than 1 mm, preferably 500 micrometers or less, preferably 100 micrometers or less.

Some of the characteristics sought in a microfluidic propulsion system include high fluid flow rates, the ability to change direction of the flow, minimal power requirements and the ability to effectively propel a wide variety of fluids through structures composed of a wide variety of solid materials. High fluid flow becomes more difficult as microfluidic structures become smaller. This is due to increased drag created by moving along the walls of the microfluidic structure. A small power requirement is desired so that devices may be compact and portable. Different microfluidic technologies have advantages and disadvantages in these areas.

It has been found that by forming a gradient of a hydrophobic film across a glass or silica plate, water droplets can be induced to travel along the gradient. However, this method has only achieved relatively slow flow rates. In addition it is difficult to scale down to the microfluidic level of less than 500 micrometers. Hydrophobic films tend to work best on relatively large water droplets. It is impossible to change flow direction and is only effective on aqueous solutions.

There has been some experimentation in using temperature gradients to propel water through small channels. Although flow is reversible, flow rate is very slow. This technique also requires a relatively large power supply.

Electrokinetics has been a popular field of study in microfluidics. It provides for easy change of flow direction and is suitable for very small channels. It is also well suited for separating chemicals. However, electrokinetics suffers from disadvantages. It is very sensitive to the chemical properties of both the fluid being manipulated and the walls of the channel. In addition, this technology requires high voltage and can only achieve relatively slow flow rates.

Electrokinetics also will not work in the presence of air bubbles, which are common in microfluidic systems. Another disadvantage is that electrokinetics is ineffective on organic fluids. Like hydrophobic films, this method only works well on aqueous solutions. Application of a strong current may also alter chemicals present in the solution, thereby decreasing the accuracy of any analyses.

Mechanical methods of pumping fluids through microstructures also pose several problems. The mechanical methods usually require valves which can complicate fabrication and become clogged. Complex mechanical devices, including many valves, are difficult to scale down to small sizes. In addition, mechanical pumping usually requires a pulsating flow and it does not conveniently allow changes in flow direction.

Centrifugation is inexpensive and adaptable to a wide range of channel sizes. However, the flow direction cannot be reversed and this process usually involves a single-use cartridge. Centrifugation also requires a large power supply. These power requirements rapidly increase and the microfluidic structure size decreases due to drag.

There is a need for alternative non-mechanical pumping systems that are lower power, operate with a wider range of device materials and solutions compositions, offer multi-use capabilities, and allow easy change in flow direction.

Magnetohydrodynamics (MIHD) has been proposed as an alternative method for microfluidic propulsion. This technology involves the application of a magnetic field and an electric field. The two fields are applied perpendicular to each other and perpendicular to the desired direction of flow. These fields induce fluid flow perpendicular to both fields. This is known as a Lorentz force. On larger scales, the Lorentz force is too weak for any practical applications and until recently has been considered only a curious phenomenon.

MHD works best when current density is high, and most electrodes have fairly low current density. However, because of the physics unique to small scale diffusion, microelectrodes exhibit very high current densities. MHD is therefore much more practical at very small scales. Relatively little power, less than one volt, can achieve high flow rates in microfluidic structures.

MHD is very susceptible to change of flow direction. By simply alternating the electrodes, the direction of fluid flow reverses. Similarly, reversing the magnetic field will also reverse flow direction. The ease of change in flow direction coupled with low power and high flow rate make MHD an excellent mechanism for microfluidic propulsion. In addition, Lorentz forces apply to all fluids, so that MHD may effectively propel both aqueous and organic solutions. MHD is also unaffected by the materials used to construct microfluidic structures.

There have been limited attempts to apply MHD technology to microfluidics already. It has been used successfully on molten metals and mercury. However, these generally involve high temperatures and are not well suited to be used in conjunction with chemical assays. These methods have high power requirements and chemical assays are generally not designed to utilize molten metals.

More recently, attempts have been made to apply MHD to aqueous solutions. Channels have been constructed having electrodes on opposing walls. A magnetic field is then applied perpendicular to both the direction of flow and the electric field generated by the electrodes. Unfortunately, a significant problem has arisen due to water electrolysis. Although insignificant on larger scales, bubbles formed by water electrolysis within a microstructure pose serious problems. Aside from blocking fluid flow, they also disrupt the electric field. This in turn disrupts the Lorentz forces and halts fluid flow completely. Only very low voltage, which results in very slow flow rates, have been shown to be practical. At higher voltages, water electrolysis makes MHD impossible. In addition, MHD is ineffective when applied to hydrophobic, oily solutions that have dielectric points greater than that of water.

There have been attempts to use an alternating current in conjunction with a synchronous alternating magnetic field to counteract the electrolysis of water. By constantly reversing the fields, bubble formation is reduced. Unfortunately, this only provides for a minimal increase in voltage and flow before electrolysis occurs. In addition it is much more difficult to perform. It requires precise shifts in the electric and magnetic fields, otherwise the fluid does not flow at all.

It is therefore desirable to provide a microfluidic propulsion technique that requires relatively little power.

It is also desirable to provide a microfluidic propulsion technique that utilizes a constant magnetic field.

It is also desirable to provide a microfluidic propulsion technique that may be used on a variety of fluids, specifically aqueous and hydrophobic solutions and structures.

It is also desirable to provide a microfluidic propulsion technique that does not induce water electrolysis.

SUMMARY OF THE INVENTION

Figure 1:
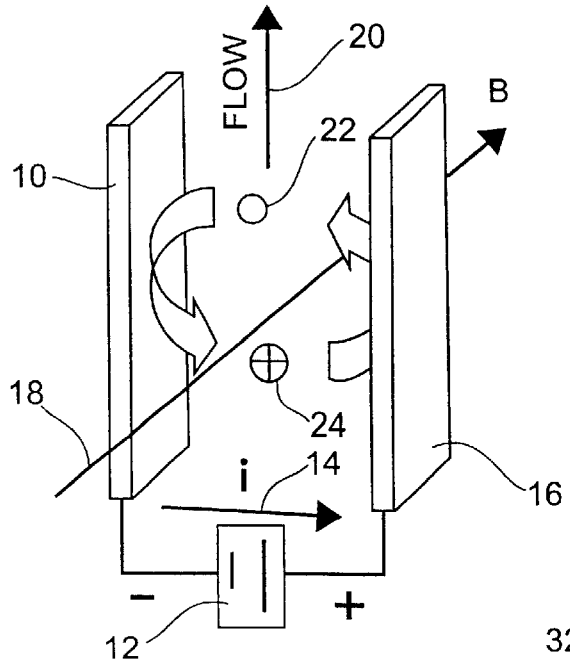
FIG. 1 shows a schematic diagram of a magnetohydrodyamic device.

The invention disclosed here is a new method of microfluidic propulsion and a set of devices that promises to solve many of the problems that other existing microfluidic methods suffer from. This new approach is capable of moving small volumes of fluids through a channel, in either direction, without valves. These devices may be constructed from a variety of materials and use voltages that are in the millivolt to volt range. In addition, this invention utilizes relatively small, constant magnetic fields that can be provided by small permanent magnets. The method disclosed is effective on extremely small samples, less than 100 picoliters. MHD is also a readily reversible method of pumping. These characteristics make this invention especially suitable for use in LOC technology. It may be used for chemical analysis of very small samples, such as those common in forensics, DNA and medical testing.

In order to avoid water electrolysis, chemicals that are highly susceptible to reduction/oxidation are added to the solution prior to its addition to the microfluidic system. These reduction/oxidation (redox) chemicals serve as "ferries" transporting electrons from the anode to the cathode. Once oxidized at the cathode, they return to the anode where they are once again reduced. This cycle is repeated many times. By using redox chemicals in the fluid as electron transporters, electrolysis of water is avoided. The redox species in the solution are propelled in a direction perpendicular to both the electric and magnetic fields. This movement of the redox species causes the entire solution to flow in the same direction. This constitutes a significant improvement over existing microfluidic technology.

In addition to redox species, other current carrying species may be used. Metallic nanoparticles may be added to the solution that accomplish the same motion as redox compounds. The nanoparticles ferry electrons, thereby allowing current to flow through the solution. This is necessary for the Lorentz forces to take effect. The movement of nanoparticles causes the entire solution to move.

Mixing is generally difficult with extremely small volumes. Sample preparation and assays, such as immunoassays and DNA analysis involve combining of re-agents in very small amounts. Small samples pose challenging problems in analyzing their content, since signal of small volumes is generally small or requires special equipment to achieve high sensitivity. Some chemical detection methods, such as electrochemical detection, have a signal that depends on how fast the molecular species move past the detector or a modified surface which captures the analyte. The inability to mix extremely small volumes allows diffusion to predominate and significantly reduces the accuracy of small sample analysis. The invention disclosed herein allows mixing of such small samples and can significantly improve the accuracy of small sample analysis. Methods of mixing extremely small samples have eluded scientists for years. In the present invention, relatively high concentration of current carrying species, such as redox chemicals, nanoparticles, or the like are usually used. This guarantees the inhibition of water electrolysis. The current carrying species carries the entire current. This also rapidly and effectively mixes samples as small as a hundred picoliters. The rapid movement of the redox species or nanoparticles mixes the solution.

Another advantage provided by the present invention is that a wide variety of redox chemicals may be used. It may be desirable to use MHD microfluidic technology to analyze chemicals that react with various redox compounds. In such situations, a different, non-reactive redox chemical, nanoparticle or the like may be employed instead without any adverse effects. This ability to choose from a wide range of suitable current carrying species makes the present invention more practical and more adaptable than other microfluidic pumping methods. It is also possible that small scale, portable LOC devices may be exposed to various extreme conditions. Some conditions such as extreme pressures, heat or cold may have an adverse effect on certain redox chemicals. Again, in these situations specific redox chemicals may be employed that best suit a given situation.

In the present invention, a small channel is formed through which the fluid flows. To avoid evaporation, the channel is enclosed on four sides. Two opposing sides consist of electrodes. It is usually desirable that these electrodes may be switched, so that each alternates between being a cathode and an anode. A magnetic field passes through the two remaining walls, perpendicular to the electric field created by the electrodes. A solution having a current carrying species is introduced to the channel. Lorentz forces affect the current carrying species, propelling them in a direction perpendicular to both the electric and magnetic fields. The current carrying species in turn causes the solution to move through the channel.

The present invention also allows the pumping action of the MHD microfluidics channel to be separated from the analyte solution. A hydrophobic solution having a current carrying species may be used to push an aqueous solution through a microfluidic channel. The two solutions will not mix together. This provides many advantages. Many analytes may react with redox species or nanoparticles to form different compounds. This will decrease the accuracy of any measurements of the analyte. Current carrying species may disrupt the method of detection of the analyte, causing false positives or false negatives. By separating the analyte solution from the pumping solution, the analyte remains unaffected.

It is therefore an object of the present invention to provide an effective method of microfluidic pumping.

It is another object of the present invention to provide a method of using (MHD) technology to pump microfluidic samples without inducing water electrolysis.

It is another object of the present invention to provide a method of rapidly and effectively mixing extremely small samples. It is another object of the present invention to provide a method of pumping microfluidic samples that is effective for a wide variety of sample solutions.

FEATURES OF MICROFLUIDICS

| Feature | Electro-kinetic | Mechanical | Centrifugal | Magnetohydro-dynamic |
|---|---|---|---|---|
| Flow and Profile | Limited (slow) & flat | Variable & non-flat | Variable & non-flat | Variable (slow) & non-flat |
| Reversible Direction | Yes | Yes (valves, pulsed) | No | Yes |

-continued

FEATURES OF MICROFLUIDICS

| Feature | Electro-kinetic | Mechanical | Centrifugal | Magnetohydro-dynamic |
|---|---|---|---|---|
| Voltage & Power | High (100%'s to 10000's V) | For pump devices | For Spinning | 0.01 V to 1 V |
| Versatile Materials and Solvents | No | Yes | Yes | Yes |
| Easy to Miniaturize, low complexity | Yes (device) No (power) | No (moving) parts, valves | No (moving parts, detection) | Yes (battery) |

DETAILED DESCRIPTION OF THE PREFERRED EMBODIMENTS

MHD Lorentz forces have been known to physicists for almost 200 years. It involves 3 physical fields all perpendicular to one another. The flow or velocity field is aligned perpendicular to both the magnetic and electric fields which are also perpendicular to one another. Manipulation of any two of these fields results in a change in the third one. In the present invention, an electric field and a magnetic field are applied to a channel both being perpendicular to the desired direction of flow.

MHD technology requires a relatively dense current in order to induce a significant rate of flow through the channel. At larger scales this is not practical. Small scale, microfluidic channels however, because of the unique properties associated with microelectrodes in close proximity to one another, allow for relatively high current densities. These may be combined with natural magnets. Magnetic fields on 0.4T or less may be adequate. Because natural magnets and a low amount of electricity are all that is required, MHD technology is especially well suited for LOC.

Microfluidic MHD channels may be constructed from a variety of materials. Channels formed from ceramic tape and glass slides are discussed in detail below. However, any substrates susceptible to microfabrication are suitable.

The current carrying species may be any chemical compound capable of readily acquiring and releasing one or more electrons. Those skilled in the art of chemistry will recognize that there are a large number of chemical compounds, generally known as redox compounds or species that would serve as adequate current carrying species. Two common examples of well known redox compounds are ferricyanide and hydroquinone. Also, small particles, called nanoparticles, of may also serve as adequate current carrying species. Nanoparticles may be comprised of metals, carbon fibers, conductive plastics or the like. Depending on the solution to which they are added, redox species or nanoparticles may be hydrophobic, hydrophilic or amphoteric.

FIG. 1 illustrates the principles by which the present invention operates. Electrodes 10 and 16 are connected to an electrical power source 12. Electrode 16 works as a cathode while electrode 10 works as an anode. This creates an electrical field represented by directional arrow 14. Natural magnets, not shown in this drawing are used to apply a magnetic field represented by directional arrow 18. The magnetic field is applied perpendicular to the electric field. Current between the cathode 16 and anode is carried by a current carrying species 22. Current carrying species 22 acquires an electron from anode and is transformed into the reduced form of the species 24. The reduced species 24 then carries the electron to cathode 16 where it discharges it. This process is repeated many times. Electric field 14 created by the redox cycling of the current carrying species, in conjunction with the magnetic field, induces flow of the current carrying species in the direction of directional arrow 20. The flow induced within the current carrying species is transferred the entire solution located between the electrodes.

Figure 2:
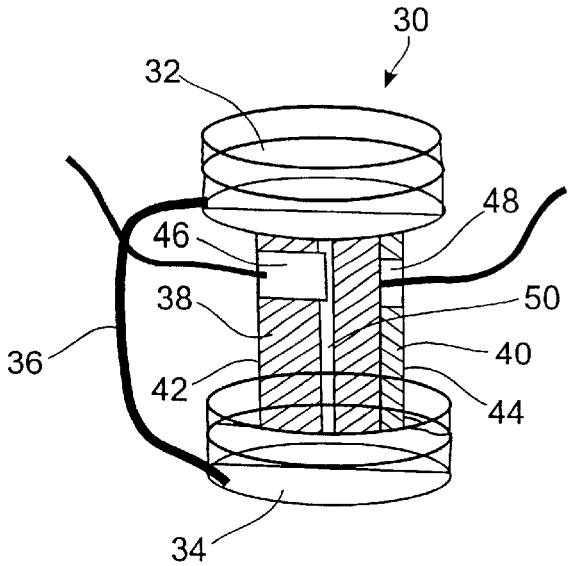
FIG. 2 shows a schematic diagram of an alternative magnetohydrodyamic device formed on a glass substrate.
Figure 3:
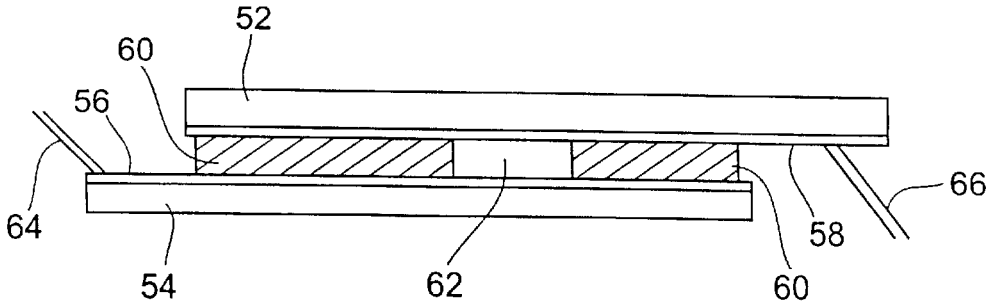
FIG. 3 shows a cross-sectional view of the schematic diagram of FIG. 2.

FIGS. 2 and 3 illustrate a MHD channel formed between 2 glass slides. To form this micro channel, an electrode is first deposited on each glass slide. An insulating material is then used to form a channel on one slide and then the second slide is attached. The slides are positioned in such a way that the electrodes deposited each run along a wall of the channel. Reservoirs are then placed at each end of the channel, a magnetic field is applied, and current is sent through the electrodes. A current carrying species within the solution carries the current and creates an MHD effect. In FIG. 2 MHD device 30 has an upper reservoir 32 and a lower reservoir 34. Lower reservoir 34 is sealed so that it is air tight and is connected to upper reservoir 32 by pressure equalizing tube 36. As solution is transferred to upper reservoir 32, a partial vacuum is created in lower reservoir 34, making it more difficult for the device to draw solution out of reservoir 34. Equalizing tube 36 releaves this vacuum pressure.

Glass slides 42 and 44 have electrodes 46 and 48 respectively. Electrodes 46 and 48 are on the sides of slides 42 and 44 that face each other. This way electrodes 46 and 48 lie along 2 opposite walls of the channel. Insulating material 38 and 40 lie between slides 42 and 44, and adhere to each of them. Insulating material 38 and 40 may be comprised of any of a number of materials. Polydinethylsiloxane (PDMS) elastomer, polyimide and various photo resists may all be used. It is also possible to use double sided adhesive tape for the insulating material.

FIG. 3 shows a cross sectional view of an MHD channel formed by the following process:

PDMS Microfluidic Devices for use with MHD

Device Fabrication Procedure

Electrode Fabrication

1. Glass microscope slides are piranha cleaned for 30 minutes then rinsed thoroughly with water.
2. Deposit a 100 Å chromium adhesion layer, then 6000 Å of gold on a glass microscope slide using a thermal evaporator.
3. Coat the deposited glass slides with approximately 1.5 mL of HPR-504 positive photoresist
4. Spin coat the slides for 20 seconds at 2000 rpm
5. Bake the slides for 9 minutes at 103° C. on top of petri dishes.
6. Place the electrode photoplot film ink-side down on top of the deposited slide and place another slide on top of the film
7. Expose slides to UV light for 30 seconds for each half of the slide (1 minute total).
8. Develop the exposed slide for 1 minute in a 50:50 solution of water: developer solution.
9. Place the slides in Aqua Regia (3:1 $HCl:HNO_3$) for 3–4 minutes or until the gold is etched away. Rinse with water.
10. Place the slides in a Chromium Etch agent for 1 minute, or until all of the chromium has been etched away. Rinse with water.
11. Rinse all remaining photoresist away with acetone and rinse with water.

The pattern from the electrode film should now be transferred onto the glass slide.

Channel Mold Fabrication

1. A silicon wafer is piranha cleaned for 30 minutes then rinsed thoroughly with water.
2. Coat the wafer with SU-8 25 (Microchem Corp), a negative photoresist.
3. Spin coat the wafer for 30 seconds at 2000 rpm.
4. Soft bake the wafer for 5 minutes at 95° C.
5. Place the channel film ink-side down on top of the wafer and place a microscope slide on top of the film.
6. Expose the wafer for 5 minutes.
7. Hard bake the wafer for 15 minutes at 95° C.
8. Develop the exposed wafer for 3 minutes (1 minute of agitation and soaking for 2 minutes) in SU-8 Developer.
9. Spray with fresh developer
10. Bake at 60° C. until dry.

The mold should be hard.

Transferring Channel to Electrode Slide

1. Mix polydimethylsiloxane (PDMS) elastomer and curing agent (10:1 by weight) thoroughly
2. Degas mixture for 10–30 minutes
3. Pour mixture on top of channel mold
4. Press electrode slide firmly against the channel mold
5. Bake for 1–3 hours at 60° C. until cured
6. Peel the electrode slide and the channel mold wafer apart. The PDMS should adhere to the glass electrode slide, thereby transferring the channel design onto the electrode slide.
7. Clear the residual PDMS out of the channels using a sharp object (i.e. razor blade)
8. Piranha clean the electrode slide with the PDMS and another electrode slide (which has holed drilled in it for the reservoirs) for 15 minutes and rinse thoroughly with water.
9. Immediately rinse both slides with methanol and press them together (gold sides facing each other).
10. Bake at 65° C. until methanol is completely dry. The two slides should now be joined together.

This process creates the sandwich arrangement in FIG. 3. In the particular embodiment described above. Glass slides 52 and 54 are used as the beginning substrate. However, any substrate susceptible any process of depositing layers of conducting material may be used. Oxidized silicon wafers and polyimide films are examples of other suitable substrates.

The channel formed by this process may be as little as 12 microns wide and 12 microns long. However, it is also possible to form channels 12 microns wide and several millimeters long. This process allows the formation of a structure having several channels in a variety of designs.

Also in this embodiment, thermal evaporation is used to deposit gold electrodes 58 and 56 onto slides 52 and 54 respectively. However, those skilled in the art will appreciate that there a variety of methods for depositing these electrodes. Electron beam evaporation, sputtering deposition, spin coating, molecular beam epitaxy or the like are suitable alternatives to thermal evaporation. Which method of deposition is preferred will depend on the type of substrate used, the use to which the MHD device is to be put, the desired characteristics of the MHD device and other factors known to those skilled in the art.

Those skilled in the art will also appreciate that gold is only one of many suitable materials for the conducting layer.

Other metals such as copper and aluminum are suitable for use as electrodes. It may also be desirable to use non-metallic conductors, such as carbon fibers for the electrode layer.

Insulating layer 60 is sandwiched between slides 52 and slides 54 in order to form channel 62. Slides 52 and 54 are positioned such that electrodes 58 and 56 face one another. Slides 52 and 54 are off set from one another to facilitate attachment of conducting wire 64 and 66 that lead to an electrical current source. In this particular embodiment, PDMS is used as the insulating layer. This layer may be as thin or as thick as desired. The only limit on the thickness of the layer is that is must be thick enough to prevent shorting between electrodes 58 and 56.

Figure 4A:
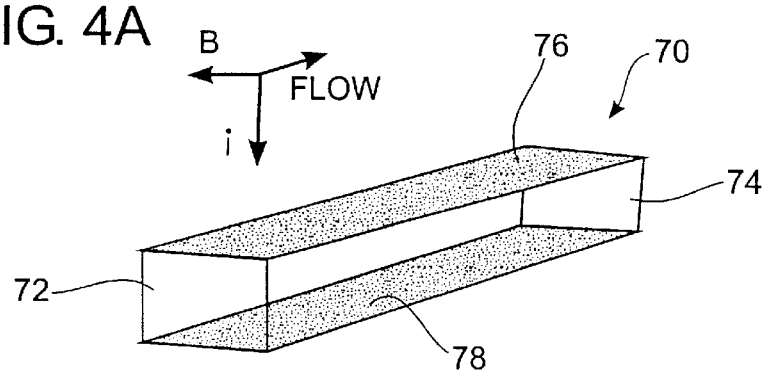
FIG. 4A shows a perspective view of a magnetohydrodyamic channel.

FIGS. 4A, 4B, 4C and 4D all show alternative designs for a MHD channel. In FIG. 4A, general MHD channel 70 has a basic design. Anode 76 comprises 1 of 4 walls of the channel. Cathode 78 comprises the opposite wall of channel 70. Side walls 72 and 74 are comprised of an insulating material. FIG. 4A illustrates the simplist design where anode 76 and cathode 78 each comprise an entire wall of the channel.

Figure 4B:
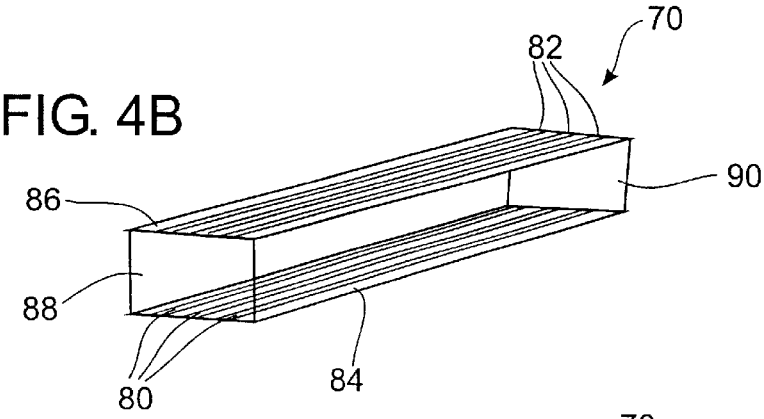
FIG. 4B shows a perspective view of an alternative magnetohydrodynamic channel.

FIG. 4B illustrates a more complex design for channel 70. In this embodiment, wall 86 has a series of anode bands 82 running down the length of the wall. Here there are 3 anode bands 82 but this number may vary. Similarly, wall 84 has a series of cathode bands 80 running along its length. Preferably there are the same number of anode bands 82 and cathode bands 84. However, this is not necessary. Side walls 88 and 90 are comprised of insulating materials.

Figure 4C:
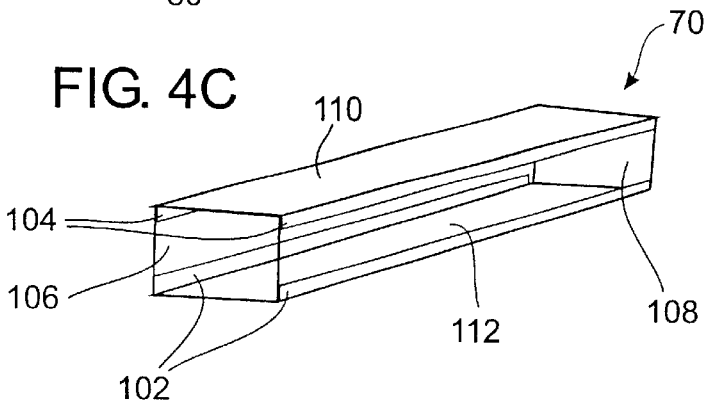
FIG. 4C shows a perspective view of an alternative magnetohydrodynamic channel.

FIG. 4C shows another alternative embodiment for channel 70. In this particular embodiment, anode bands 104 are located on the edges of wall 110 in the corners of the channel created by walls 110, 106 and 108. Similarly, cathode bands 102 are located in the corners formed between wall 112 and walls 106 and 108. Those skilled in the art will realize that the different geometries found in 4A, 4B and 4C are slight and that the channels are substantially similar.

Figure 4D:
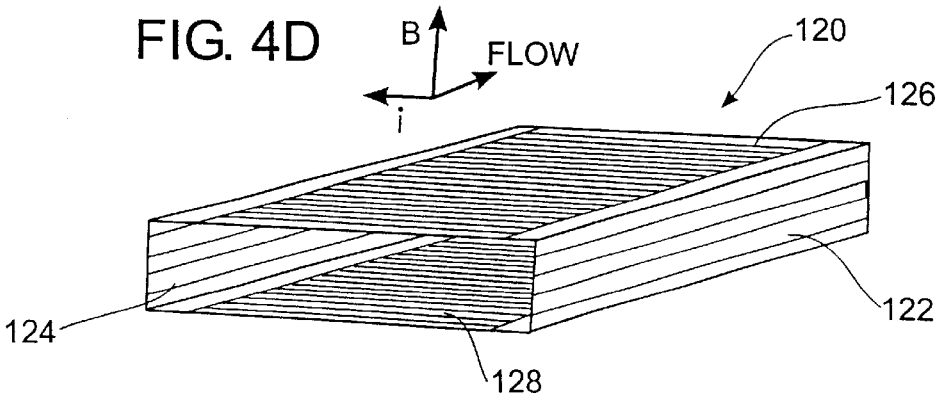
FIG. 4D shows a perspective view of an alternative magnetohydrodynamic channel.

FIG. 4D shows an alternative embodiment that has significant differences from the other illustrated embodiments. Channel 120 is specifically designed to alter the flow profile of the fluid within the MHD channel. Microfluidic channels impose a significant amount of drag on solutions that pass through them. This creates a "D" shaped flow profile. In some situations, it may be advantageous to have a more square shaped flow profile. Channel 120 alters the flow profile by replacing the insulating walls with passive equilibration conducting walls 126 and 128. Passive equilibration conducting walls 128 and 126 contact anode wall 122 and cathode wall 124. The partial equilibration conduction caused by walls 126 and 128 effect the flow pattern of the fluid within the channel 120.

The magnets used to induce the magnetic field are not shown in these drawings. Those skilled in the art will understand that the magnets do not need to be an actual physical contact with the channel or the solution within the channel. It is only necessary that magnets be positioned close to the MHD channel in order to induce a magnetic field in the proper orientation.

Figure 5A:
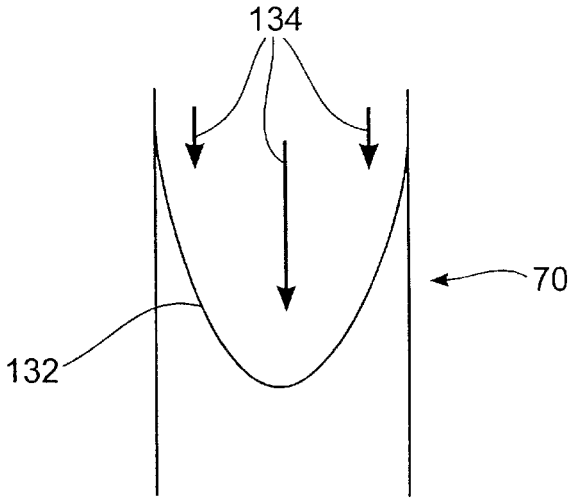
FIG. 5A shows a schematic diagram of a flow pattern of a solution within a magnetohydrodynamic channel.
Figure 5B:
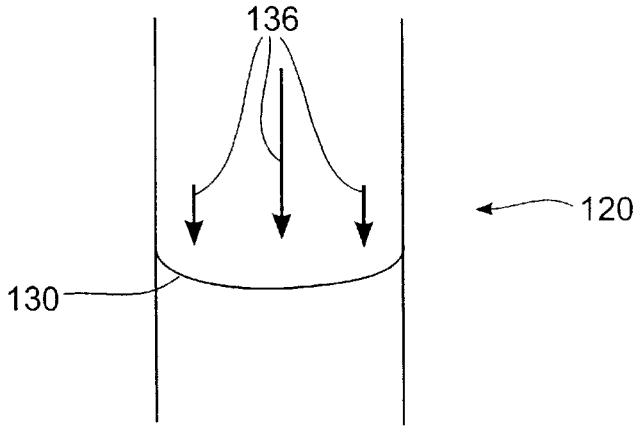
FIG. 5B shows a schematic diagram of an alternative flow pattern of a solution within a magnetohydrodynamic channel.

FIGS. 5A and 5B illustrate different flow patterns. FIG. 5A illustrates the flow through general channel 70. Fluid 132 flows unevenly as indicated by flow vector arrows 134. The least amount of drag is experienced by the portion of the fluid in the middle of the channel. This creates a cone shaped flow pattern. FIG. 5B illustrates a square shaped flow pattern. Fluid 130 moves at an even rate as indicated by flow vector arrows 136. Passive equilibration causes this type of square shaped flow pattern.

Figure 6:
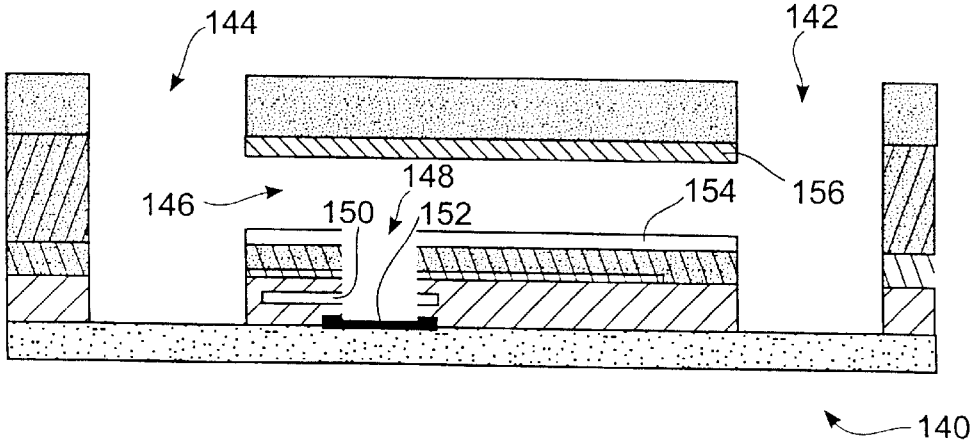
FIG. 6 shows a schematic diagram of an alternative magnetohydrodyamic device.

FIG. 6 shows a microfluidic MHD channel combined with a microcavity sensing device. Microfluidic structure 140 has a first reservoir 142, a second reservoir 144, a microfluidic MHD channel 146 and a microcavity 148. The magnet used to induce a magnetic field is not shown in the illustration. Electrodes 156 and 154 are used in conjunction with an exterior magnet to create the MHD effect. This causes solution in reservoir 142 to enter channel 146 and pass through it, eventually reaching reservoir 144. When the solution encounters microcavity 148, microcavity electrodes 150 and 152 may be used to detect various analytes. Such microcavities are described in detail in U.S. patent application Ser. No. 09/946,249 and U.S. patent application Ser. No. 09/978,734. The microfluidic structure shown in FIG. 6 is a relatively simple design. It may be desirable to incorporate several microcavities along the wall of microfluidic MHD channels. The presence of the magnetic field also induces mixing within the microcavity. This can increase the speed and accuracy of the detection of analytes within the analyte solution.

In an alternative embodiment of microfluidic MHD channels, the channels are fabricated in ceramic tape commercially available from DuPont. The Microfluidic devices are fabricated on Green Tape™ 951 series and 851 series ceramic tape. The designs consist of microchannels fabricated on 6 in.$^2$ pieces of substrates with gold electrodes screen printed on the sidewalls of the channels. The thickness of the screen print is 12 um. These electrodes extend to form contact pads at the side of the chip for edge connectors. The gold electrodes form the electrical part of the magnetohydrodynamic pump. The current design does not have the magnetic part of the pump integrated into the chip.

The material used in fabrication is known as Green Tape™ ceramic tape and is also known as Low Temperature Co-fired Ceramic (LTCC). In the pre-fired state the ceramic tape consists of alumina particles, glass frit and organic binder. In the pre-fired state the ceramic tapes are soft pliable and easily machinable. Mesoscopic features ranging in size from 10 $\mu$m to 10 mm can be machined using mechanical, chemical and thermal means. This material is compatible with high conductivity metals such as gold and silver.

Green Tape™ ceramic tape comes in two varieties. The 951 series and the 851 series both have similar compositions but the 851 is white in the pre-fired state and the 951 is blue.

Fabrication Terminology:

Via—hole punched in ceramic tape using a punching machine

Filled vias—vias filled with metal to form electrical interconnects between layers Catchpads—patches of metal printed on the tape directly above filled vias to assist with the electrical interconnect.

Registration holes—vias punched at four corners of the ceramic tape to assist in stacking of the tapes during the lamination process Alignment holes—vias close to the registration holes to assist with alignment during the screen print process Screen print—process of printing metal on to the ceramic tape.

The fabrication process for the Green Tape™ ceramic tape proceeds in several steps. The tape comes in a roll, which is then cut into 6 in$^2$ pieces then cured at 120° C. for 30 mins. Then registration and alignment holes are punched along with other features necessary for the overall function of the device such as microchannels and vias. Each layer is fabricated separately. These individual layers will eventually be arranged in the proper order (stacked) to form a 3D structure. The next step after punching is the via fill. In this stage vias are filled with metal. These help to form electrical interconnections between layers. After this, screen-printing of the gold electrode ensues. By this stage all the microchannels have been punched on the tape and the sidewalls of the microchannel is coated with metal by pulling a vacuum through during the screen print. After the screen print process is lamination. With the aid of the registration holes the various layers are stacked together then vacuum sealed and a hydraulic pressure of 3500 psi at 80° C. is applied for 10 minutes. Then the substrate is baked at 850° C. for 8 hrs.

The Green Tape™ ceramic tape shrinks on heating. There is a 12% shrinkage in the x,y plane and 15% shrinkage in the z-axis. The shrinkage is predictable thus can be compensated for during the design.

There are several methods available to create vias and microchannels on the ceramic tape. These methods include milling, punching, jet vapor etching and laser machining.

A 3 dimensional channel system may be designed by stacking several layers of the tape. The sidewalls of the channels may be coated with gold and to form the electrodes for the. magnetohydrodynamic pump.

Figure 7:
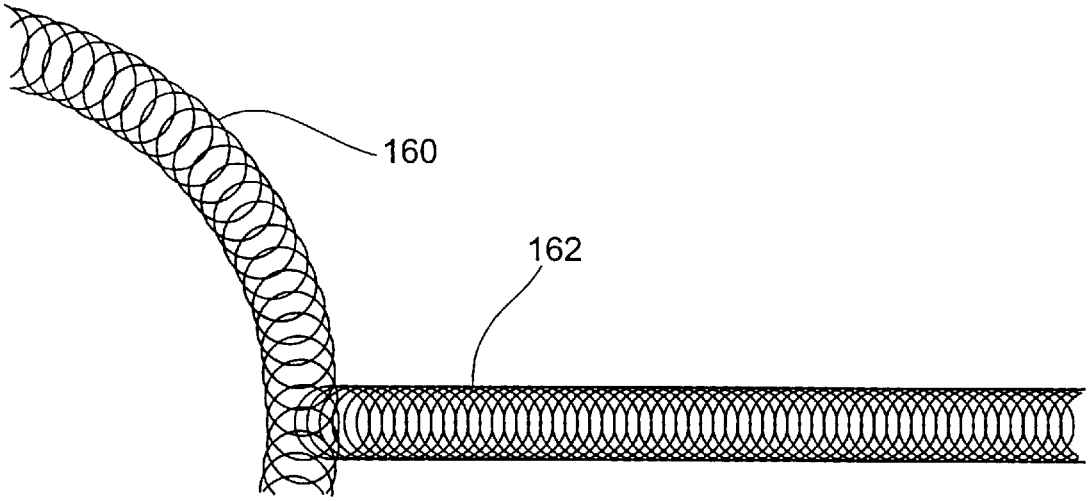
FIG. 7 shows a schematic diagram of a hole punch pattern for forming a magnetohydrodynamic device on ceramic tape.
Figure 8:
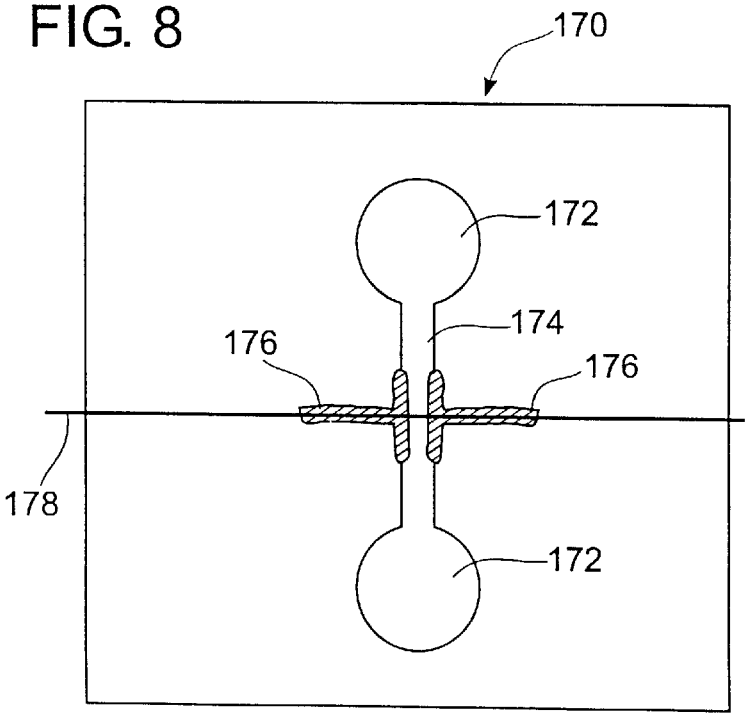
FIG. 8 shows a schematic diagram of a magnetohydrodynamic device formed on a piece of ceramic tape.
Figure 9:
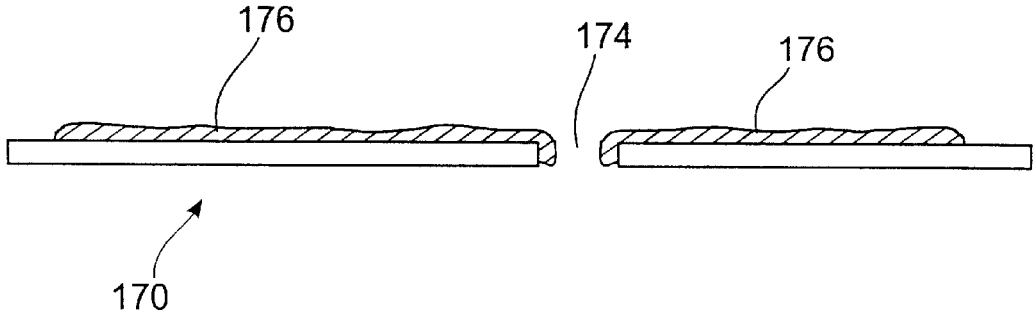
FIG. 9 shows a cross-sectional view of the schematic diagram of the magnetohydrodynamic device of FIG. 8.

FIG. 7 illustrates the use of a hole puncher to form channels and reservoirs in ceramic tape. FIG. 7 is an enlarged schematic diagram of the whole punching pattern used. Circular hole punch pattern 160 is used to form reservoirs in the tape. Straight hole punch pattern 162 is used to form a channel. By punching several holes in an overlapping manner, a channel and ring may be formed. FIG. 8 shows a top plan view of a piece of ceramic tape 170 that has had reservoirs 172 and channel 174 punched through it. Electrodes 176 are formed by screen printing conductive ink in a cross shaped pattern over the channel as shown in FIG. 8. A vacuum is applied to the opposite side of the tape. This causes the ink to run down the sides of the channel and to separate so as to form to 2 electrodes. FIG. 9 is a cross sectional view of the same piece of tape shown in FIG. 8 along cross section line 178. FIG. 9 shows how electrodes 176 run along the inside of channel 174 on opposite walls. Excess conductive ink is pulled through channel 174 by the vacuum, so as to prevent channel 174 from being filled. By this method, 2 microelectrodes 176 are formed within the channel.

Figure 10:
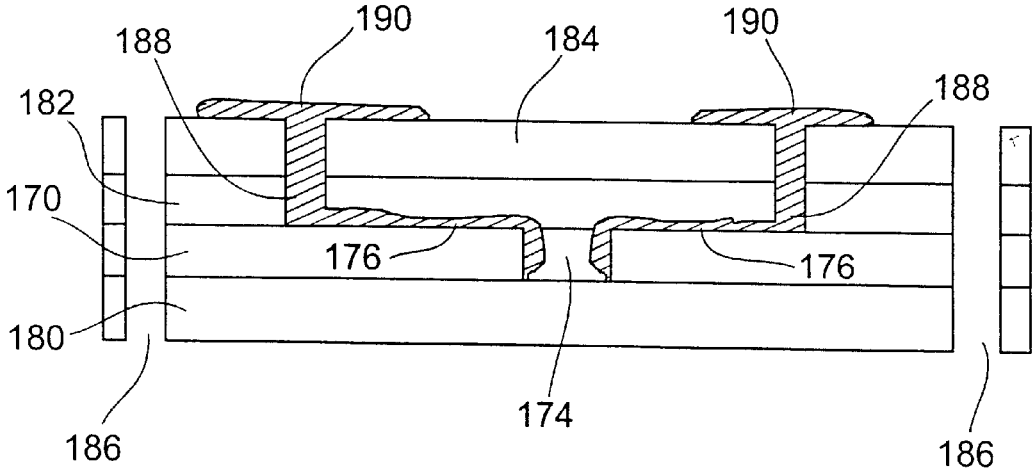
FIG. 10 shows a schematic diagram of a magnetohydrodynamic chip comprised of ceramic tape and incorporating the ceramic tape of FIGS. 8 and 9 .

FIG. 10 shows the same piece of ceramic tape stacked with additional pieces of ceramic tape in order to form a microfluidic chip. Channel tape 170 shown in FIGS. 8 and 9 rests on top of support tape 180 and underneath via tape 182. Via tape 182 has holes filled with conductive material positioned such that they engage electrodes 176. Resting atop via tape 182 is top tape 184. Top tape 184 also has vias filled with conductive material. On the top side of tape 184 are catch pads 190. The catch pads are significantly larger than the extremely small vias 188. This is to facilitate connection to an electric current. Each catch pad 190 is connected to an electric current power source, such that one acts as an anode while the other acts as a cathode. Current travels from the catch pad through the via 188 down to electrodes 176. The current carrying species within the solution in channel 174 completes the circuit.

In this particular embodiment, the conductive material that the electrodes and catch pads are comprised of and that fill the vias is either gold or silver conductive ink. However, those skilled in the art will understand that any conductive material that is compatible with co-fired ceramic tape will be suitable.

All 4 pieces of ceramic tape have aligning holes 186. Proper alignment of these holes insures that the catch pads, vias and electrodes are aligned properly so that they may conduct electric current. Once the ceramic tape pieces have been fabricated and aligned, they are fired together to form a single solid chip. Prior to firing, the tape is flexible. However, once fired the chip structure becomes rigid. Because the chip is very thin, they may become brittle if there are an insufficient number of tape layers. Therefore, it is often desirable to include extra tape layers to strengthen the chip. FIG. 10 shows a chip having 4 layers. It is often more practical to form chips comprised of 10 or more layers to add strength and support. These additional layers may consist of additional support tapes, additional via tapes and/or additional channel tapes.

Figure 11:
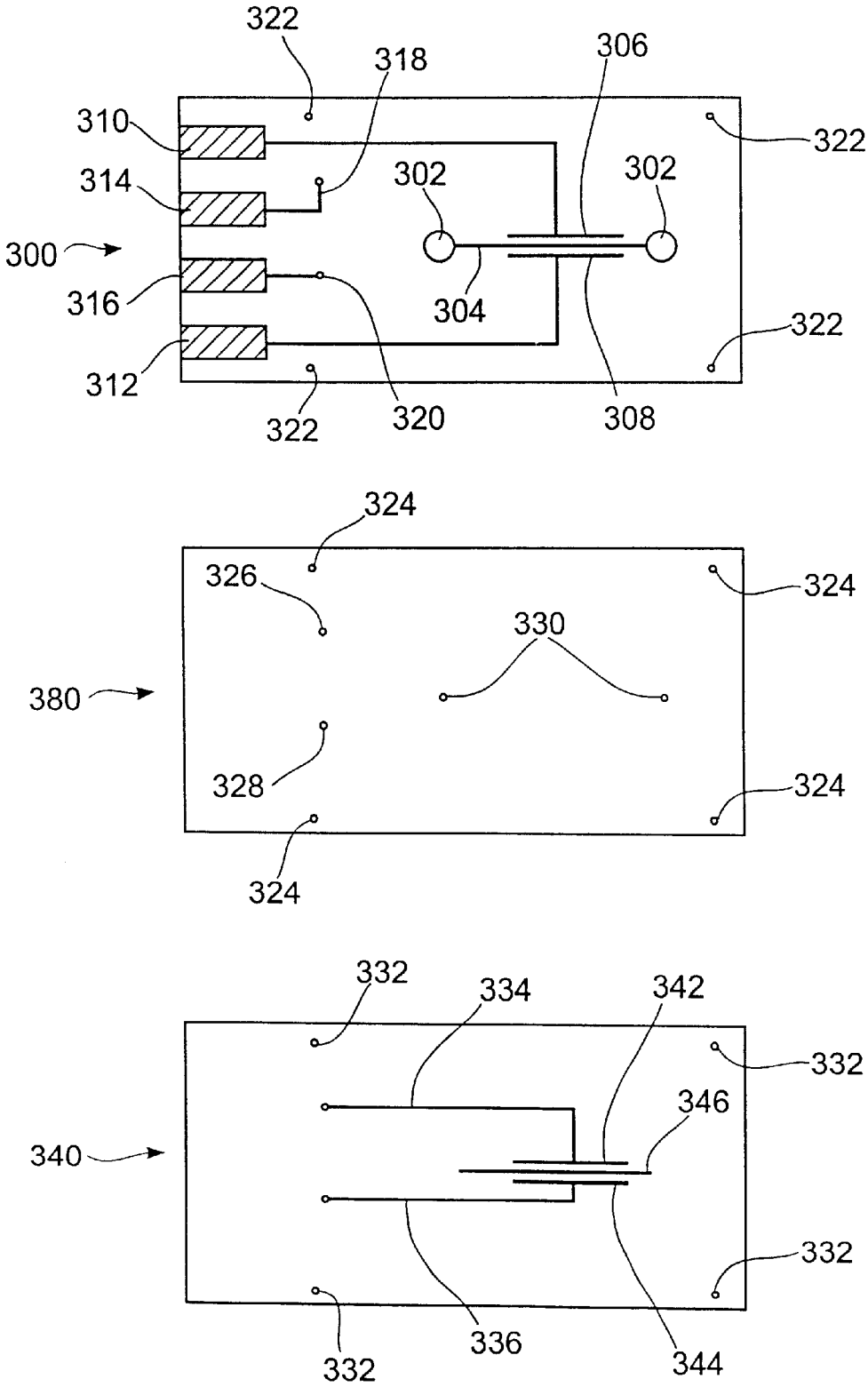
FIG. 11 shows a schematic diagram of a series of pieces of ceramic tape designed to form a magnetohydrodynamic chip having a feedback loop.

FIG. 11. shows a top down schematic diagrams of alternative chip configurations. The embodiment shown in FIG. 11 forms a microfluidic MHD channel having a feedback loop. Top plate 300 has reservoirs 302 that are connected by main channel 304. Main channel electrodes 306 and 308 are screen printed onto the ceramic tape such that they are connected to catch pads 310 and 312 respectively.

Reservoirs 302 and main channel 304 are formed by the manner shown in FIG. 7. Overlapping punch holes are used to form the pattern.

Catch pads 314 and 316 are screen printed such that conductive material connects them to vias 318 and 320 respectfully. These vias are formed using the same hole puncher used to form the reservoir/channel design. Four aligning holes 322 are also punched into the tape. Second tape 380 has aligning holes 324 that correspond to aligning holes 322 in the top tape 300. Vias 326 and 328 are filled with conductive material and correspond to vias 318 and 320 respectively. Polo vias 330 correspond to reservoirs 302. These vias are left hollow so that the solution may pass through them.

Bottom plate 340 has alignment holes 332 that correspond to alignment holes 324 and tape 380 and to holes 322 and tape 300. Conductive pattern 334 is applied to bottom plate 340 such that via 326 is conductively connected to feedback channel electrode 342. Similarly, conductive pattern 336 is applied to bottom tape 340 in such a way as to conductively connect via 328 to feedback channel electrode 344 when the 3 tapes are stacked. Feedback channel 346 is formed by making overlapping hole punches as shown in FIG. 7. Once all of the holes have been punched in the tape and the conductive material has been applied, the 3 tapes are stacked and co-fired. As with the previous example, it is often desirable to include several additional layers of tape in order strengthen the final chip.

Figure 12:
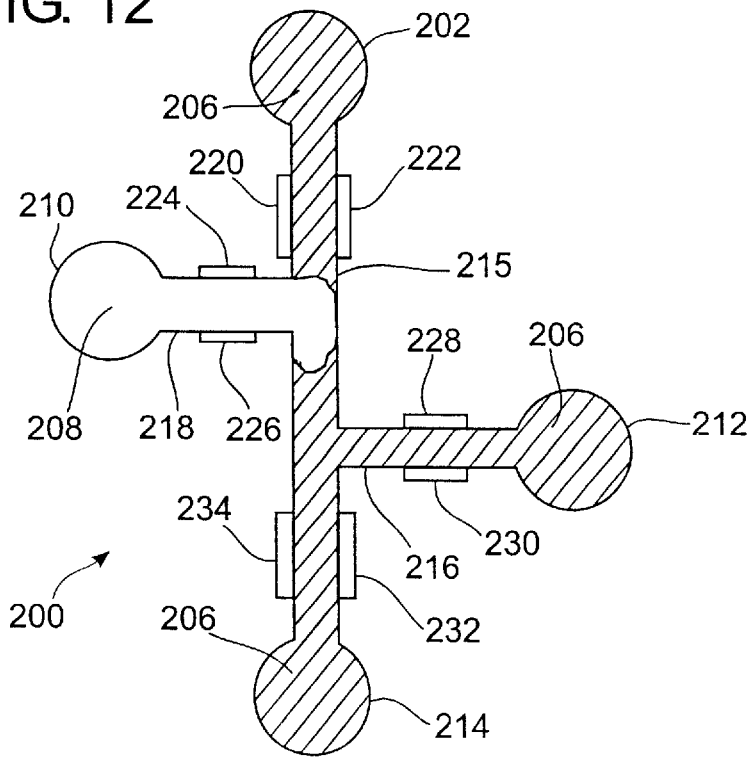
FIG. 12 shows a schematic diagram of an alternative embodiment of a magnetohydrodynamic device.

FIG. 12 shows an alternative embodiment of a microfluidic MHD channel designed to measure the volume of the analyte solution being analyzed. This embodiment is particularly well suited for keeping the analyte solution separate from the pumping solution. Analyte solution 208 is located in reservoir 210. Electrodes 224 and 226, in conjunction with a magnetic field applied to the structure 200, causes analyte solution 208 to flow through introduction channel 218 and into main channel 215. Main channel electrodes 220, 232, 234 and 222 are not active. Exit channel electrodes 228 and 230 are active and draw pumping solution 206 from the main channel 215 through exit channel 216 and into waste reservoir 212. Analyte solution 208 is drawn through the main channel 215 toward exit channel 216 by the vacuum caused by the pumping of the pumping solution 206 by electrodes 228 and 230.

Figure 13:
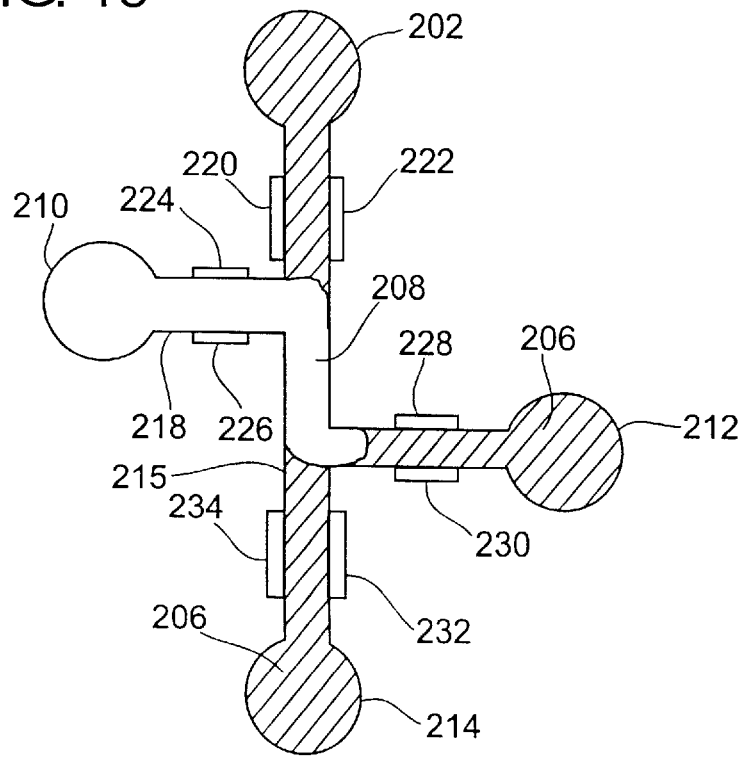
FIG. 13 shows the magnetohydrodynamic device of FIG. 12 after analyte solution has entered the main channel.
Figure 14:
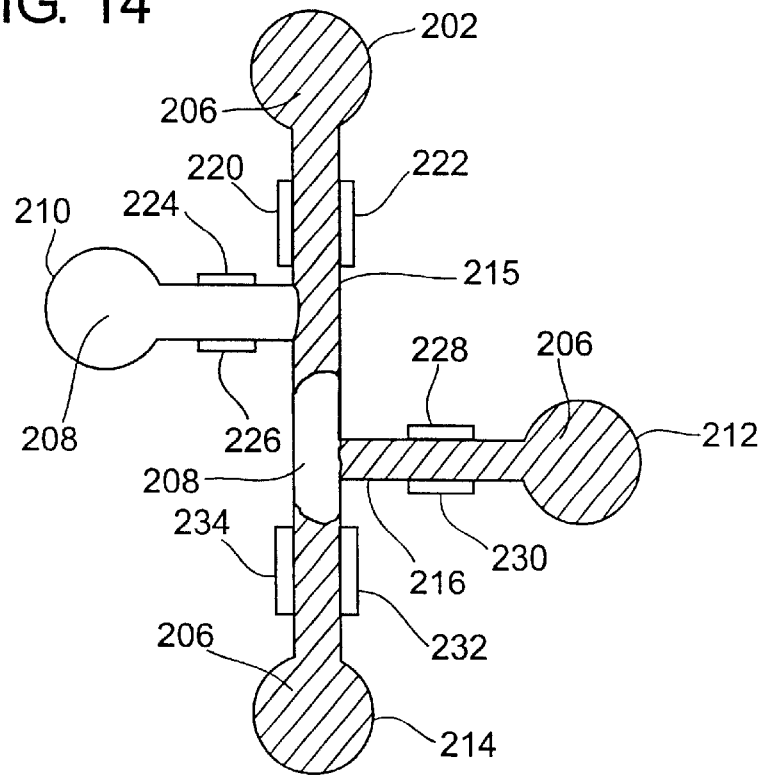
FIG. 14 shows the magnetohydrodynamic device of FIG. 12 where the device is pumping the analyte solution toward a reservoir.

Once analyte solution 208 begins to enter the exit channel 216, as shown in FIG. 13, introduction channel electrodes 224 and 226 and exit channel electrodes 228 and 230 are turned off. Main channel electrodes 220, 222, 232 and 234 are turned on to cause pumping solution 206 to enter the main channel 215 from reservoir 202 and to exit the main channel 215 into reservoir 214. The movement of the pumping solution 206 causes the analyte solution 208 to travel down main channel 215 toward reservoir 214, as shown in FIG. 14. Analysis of the analyte solution may occur at any point within the structure. In addition other microfluidic channels may be added to main channel 215 or reservoir 214 and the analyte solution may be pumped through them.

Figure 15:
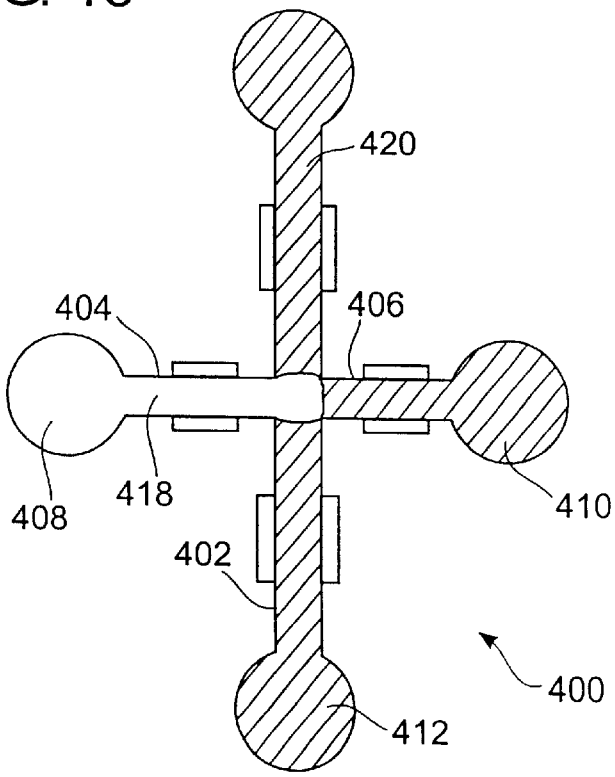
FIG. 15 shows an alternative embodiment of a magnetohydrodynamic device.

The amount of analyte solution analyzed is determined by the distance between the introduction channel 218 and exit channel 216. The distance between these two channels multiplied by the cross-sectional area of the channel equals the volume of analyte solution drawn into main channel 215. FIG. 15 shows a microfluidic structure that operates in the same fashion as the structure shown in FIGS. 12, 13, and 14. However, in structure 400 introduction channel 404 and exit channel 406 join main channel 402 at the same point. This causes the portion of the analyte solution 408 that travels to reservoir 412 to be as small as possible. Pumping solution 420 propels analyte solution 418 down main channel 402.

Pumping solutions 206 and 420 may be hydrophobic and analyte solutions 208 and 418 may be hydrophilic, or vice versa. This prevents the analyte solution from mixing with the pumping solution. Those skilled in the art will understand that there are advantages to keeping the analyte solution It may be desirable to have an analyte solution that is free of current carrying species. Other microfluidic pumping devices may be readily adapted for use in conjunction with a MHD system. The analyte solution may be introduced into the main channel using a different type of pumping. Once the analyte solution is within the main channel, an immiscible pumping solution may be used to propel the analyte solution through the structure.

Figure 16:
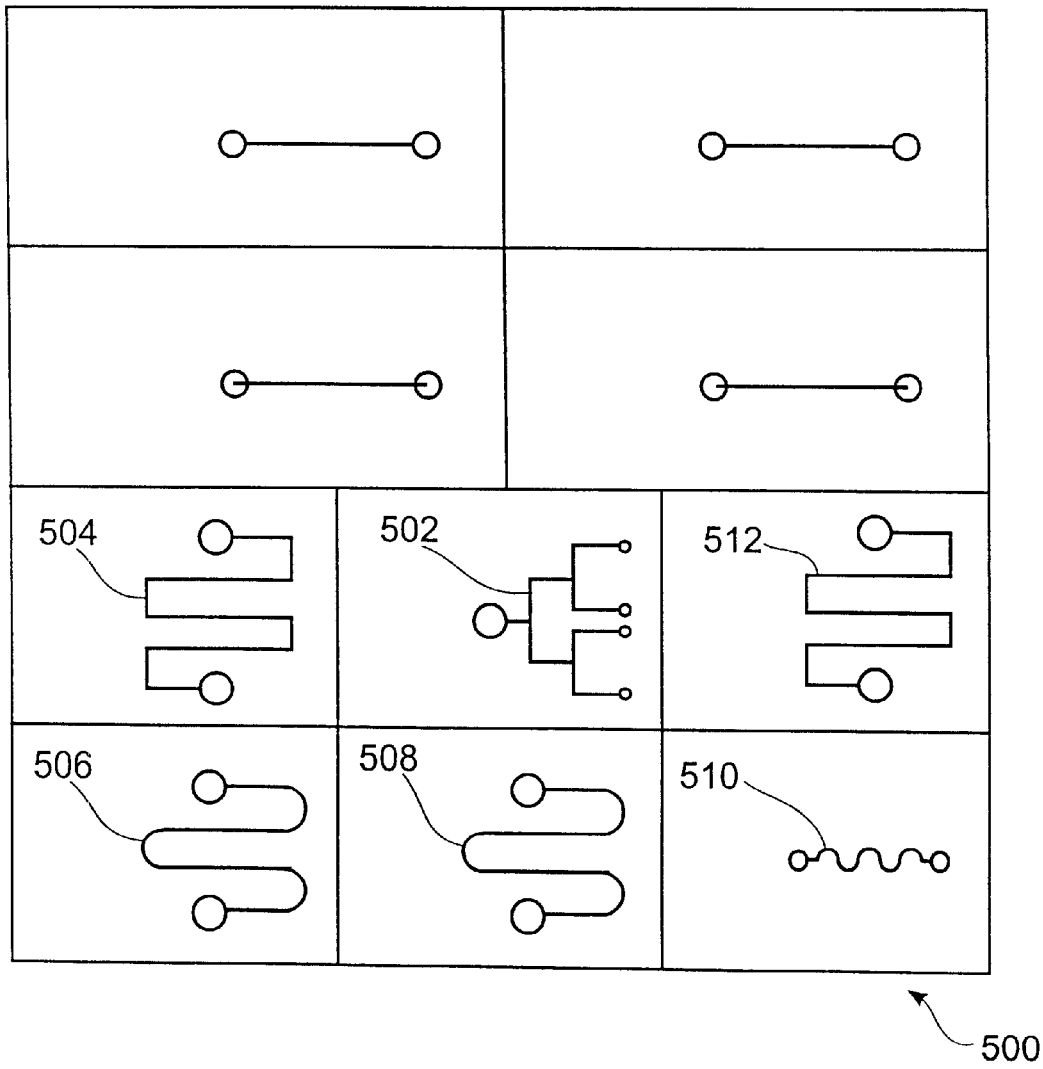
FIG. 16 shows a piece of ceramic tape having a number of microchannel structures.

The above embodiments describe a single channel with or without a second feedback loop. One embodiment describes a main channel and two side (introduction and exit) channels However, those skilled in the art will appreciate that a natural extension of these designs include a series of microfluidic channels, each utilizing the same magnetic field and each having independently addressable electrodes. These channels may be interconnected so that fluids may be propelled by Lorentz forces through more than one or all of them. FIG. 16 shows a piece of ceramic tape 500 having a number of microchannel structures. Microchannel 502 illustrates how a microchannel may have several branches, while microchannels 504, 506, 508, 510 and 512 show a variety of different microchannel patterns.

Whereas, the present invention has been described in relation to the drawings attached hereto, it should be understood that other and further modifications, apart from those shown or suggested herein, may be made within the spirit and scope of this invention.

What is claimed is:

1. A microfluidic device comprising:

at least one microfluidic channel;

at least two electrodes creating an electric field within the at least one channel;

a magnetic field within the channel and perpendicular to the electric field;

a solution having a redox compound;

wherein the electric field and the magnetic field induce the solution to flow in a direction perpendicular to both the electric field and the magnetic field.

2. The microfluidic device of claim 1 wherein said solution is an aqueous solution.

3. The microfluidic device of claim 1 wherein said solution is hydrophobic.

4. A microfluidic device of claim 1 further comprising:

at least one passive equilibration conductor within the channel.

5. The microfluidic device of claim 1 wherein the channel is less than one millimeter wide.

6. The microfluidic device of claim 1 wherein said channel is constructed from at least one layer of ceramic tape.

7. The microfluidic device of claim 1 further comprising a plurality of channels.

8. The microfluidic device of claim 7 wherein the plurality of channels is interconnected.

9. A microfluidic device comprising:

at least one microfluidic channel;

at least two electrodes creating an electric field within the at least one channel;

a magnetic field within the channel and perpendicular to the electric field;

a solution having conductive nanoparticles; and, wherein the electric field and the magnetic field induce the solution to flow in a direction perpendicular to both the electric field and the magnetic field.

10. A method for pumping a solution comprising:

adding a current carrying species to the solution;

applying an electric field to the solution by the application of between 1 and 0.01 volts; and, applying a magnetic field to the solution, wherein the magnetic field is perpendicular to the electric field and perpendicular to the desired direction of flow of the solution.

11. The method for pumping a solution according to claim 10 wherein the solution is in a channel that is less than one millimeter wide.

12. The method for pumping a solution according to claim 10 wherein the solution is in a plurality of interconnected channels.

13. A microfluidic device comprising:

at least one microfluidic channel;

at least two electrodes creating an electric field within the at least one channel;

a magnetic field within the channel and perpendicular to the electric field;

a solution comprising a redox compound and conductive nanoparticles;

wherein the electric field and the magnetic field induce the solution to flow in a direction perpendicular to both the electric field and the magnetic field.

* * * * *

UNITED STATES PATENT AND TRADEMARK OFFICE

CERTIFICATE OF CORRECTION

PATENT NO. : 6,733,244 B1
APPLICATION NO. : 10/026748
DATED : May 11, 2004
INVENTOR(S) : Ingrid Fritsch, Christopher S. Carter and Zoraida P. Aguilar It is certified that error appears in the above-identified patent and that said Letters Patent is hereby corrected as shown below:

Title page item (60), line 1, change "60/278,278" to --60/278,275--

Signed and Sealed this

Sixth Day of March, 2007

JON W. DUDAS
*Director of the United States Patent and Trademark Office*